US011244608B2

(12) United States Patent
Su et al.

(10) Patent No.: US 11,244,608 B2
(45) Date of Patent: Feb. 8, 2022

(54) IMAGE PROCESSING METHOD AND IMAGE PROCESSING DEVICE

(71) Applicant: NOVATEK Microelectronics Corp., Hsinchu (TW)

(72) Inventors: Shang-Yu Su, Hsinchu County (TW); Feng-Ting Pai, Hsinchu (TW)

(73) Assignee: NOVATEK Microelectronics Corp., Hsinchu (TW)

( * ) Notice: Subject to any disclaimer, the term of this patent is extended or adjusted under 35 U.S.C. 154(b) by 0 days.

(21) Appl. No.: 17/074,641

(22) Filed: Oct. 20, 2020

(65) Prior Publication Data

US 2021/0118360 A1 Apr. 22, 2021

Related U.S. Application Data

(60) Provisional application No. 62/923,600, filed on Oct. 20, 2019.

(51) Int. Cl.
*G09G 3/3225* (2016.01)

(52) U.S. Cl.
CPC ... *G09G 3/3225* (2013.01); *G09G 2300/0443* (2013.01); *G09G 2320/064* (2013.01)

(58) Field of Classification Search
None
See application file for complete search history.

(56) References Cited

U.S. PATENT DOCUMENTS

2005/0062767 A1* 3/2005 Choe ..... G09G 3/3607 345/694
2015/0146017 A1* 5/2015 Kim ..... H04N 17/04 348/189
2017/0249890 A1* 8/2017 Yoo ..... G09G 3/2074
2018/0330523 A1* 11/2018 Zhang ..... G09G 5/04
2020/0211163 A1* 7/2020 Chien ..... G06T 5/003

FOREIGN PATENT DOCUMENTS

TW 201616481 A 5/2016

* cited by examiner

*Primary Examiner* — Christopher J Kohlman
(74) *Attorney, Agent, or Firm* — CKC & Partners Co., LLC

(57) ABSTRACT

An image processing method, comprising the following steps: obtaining a plurality of first luminance values, wherein the plurality of first luminance values corresponds to a first subpixel group comprising a target subpixel and a plurality of adjacent subpixels; and performing a subpixel rendering conversion on a target luminance value of the plurality of first luminance values corresponding to the target subpixel according to a weighting matrix and all of the plurality of first luminance values, so that the target luminance value is converted to a rendered luminance value, wherein the weighting matrix comprises a plurality of weighting parameters corresponding to the first subpixel group, and the weighting matrix is time-variant.

16 Claims, 8 Drawing Sheets

IMAGE PROCESSING METHOD AND IMAGE PROCESSING DEVICE

CROSS-REFERENCE TO RELATED APPLICATION

This application claims priority to U.S. Provisional Application Ser. No. 62/923,600, filed Oct. 20, 2019, which is herein incorporated by reference in its entirety.

BACKGROUND

Technical Field

The present disclosure relates to an image processing device and an image processing method, which are used to drive a display panel according to luminance values to generate a corresponding image.

Description of Related Art

With the development of display technology, the display resolution of a display panel has been continuously increased accompanying with increasing dimensions of the display panel. Benefit from the higher display resolution, the pixel density of the display panel, often called pixel per inch (PPI), is also increased. To pursue a balance between image quality and the panel size, it is a good solution to use image processing techniques such as subpixel rendering (SPR) to processing image data.

Due to the restrictions of an OLED panel manufacturing process, it is proper to apply a delta pixel arrangement rather than a stripe pixel arrangement in an OLED panel with high display resolution. Due to the delta pixel arrangement, the edge of an object in an image may be displayed with undesired visual color shift when the object has a considerable luminance difference from pixels adjacent to the edge of the object, which degrades the image quality.

SUMMARY

One aspect of the present disclosure is an image processing method, comprising the following steps: obtaining a plurality of first luminance values, wherein the plurality of first luminance values corresponds to a first subpixel group comprising a target subpixel and a plurality of adjacent subpixels; and performing a subpixel rendering conversion on a target luminance value of the plurality of first luminance values corresponding to the target subpixel according to a weighting matrix and all of the plurality of first luminance values, so that the target luminance value is converted to a rendered luminance value, wherein the weighting matrix comprises a plurality of weighting parameters corresponding to the first subpixel group, and the weighting matrix is time-variant.

Another aspect of the present disclosure is a image processing device, comprising a input data conversion circuit and a subpixel rendering circuit. The input data conversion circuit is configured to obtain a plurality of first luminance values. The plurality of first luminance values corresponds to a first subpixel group comprising a target subpixel and a plurality of adjacent subpixels. The subpixel rendering circuit is electrically coupled to the input data conversion circuit, and configured to perform a subpixel rendering conversion on a target luminance value of the plurality of first luminance values corresponds to the target subpixel according to a weighting matrix and all of the plurality of first luminance values. The target luminance value is converted to a rendered luminance value, the weighting matrix is time-variant, and comprises a plurality of weighting parameters corresponding to the first subpixel group.

It is to be understood that both the foregoing general description and the following detailed description are by examples, and are intended to provide further explanation of the disclosure as claimed.

BRIEF DESCRIPTION OF THE DRAWINGS

The present disclosure can be more fully understood by reading the following detailed description of the embodiment, with reference made to the accompanying drawings as follows.

DETAILED DESCRIPTION

For the embodiment below is described in detail with the accompanying drawings, embodiments are not provided to limit the scope of the present disclosure. Moreover, the operation of the described structure is not for limiting the order of implementation. Any device with equivalent functions that is produced from a structure formed by a recombination of elements is all covered by the scope of the present disclosure. Drawings are for the purpose of illustration only, and not plotted in accordance with the original size.

It will be understood that when an element is referred to as being "connected to" or "coupled to", it can be directly connected or coupled to the other element or intervening elements may be present. In contrast, when an element to another element is referred to as being "directly connected" or "directly coupled," there are no intervening elements present. As used herein, the term "and/or" includes an associated listed items or any and all combinations of more.

Figure 1:
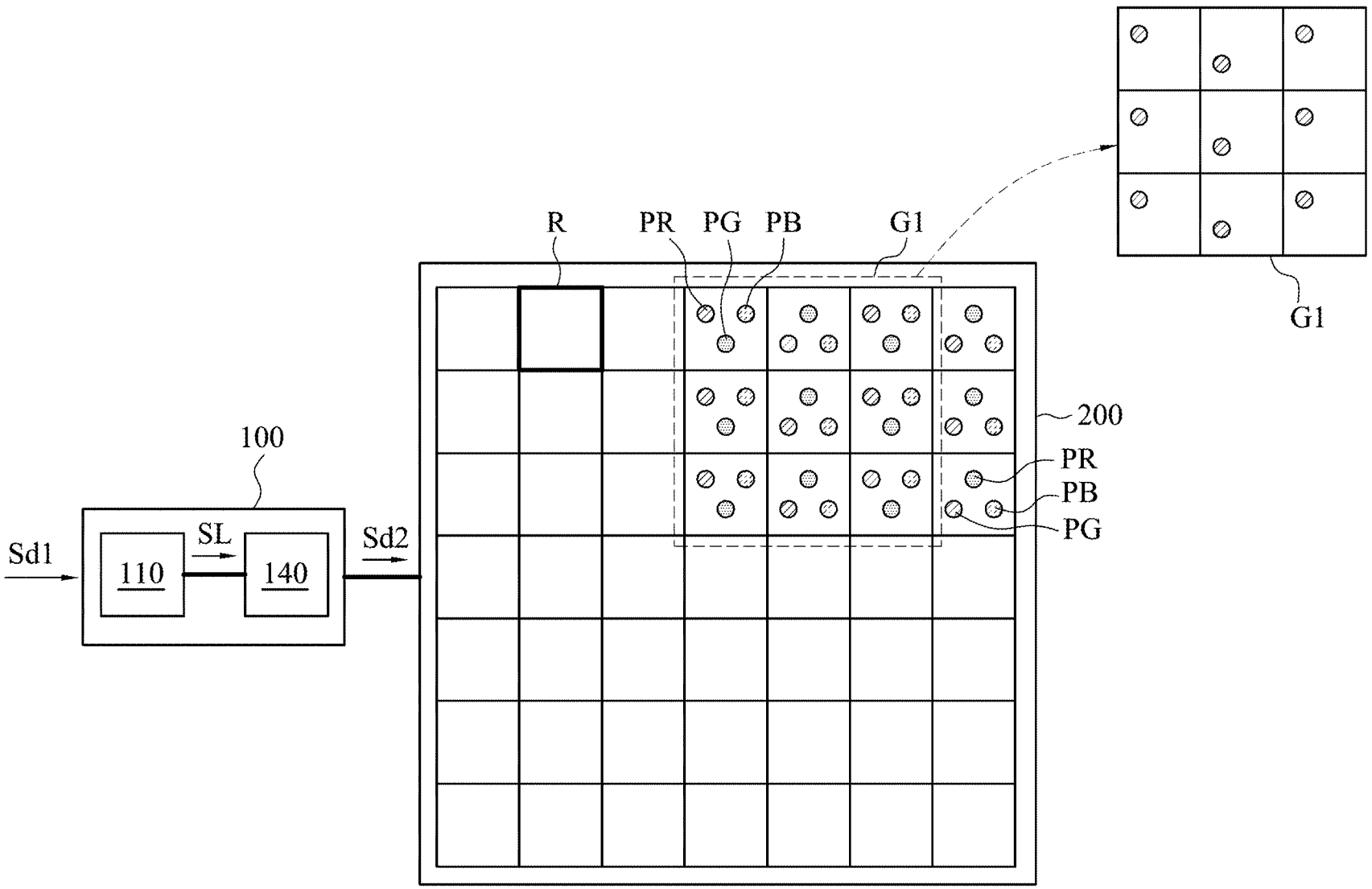
FIG. 1 is a schematic diagram of the image processing device and a display panel in some embodiments of the present disclosure.

The present disclosure relates to an image processing device and an image processing method. FIG. 1 is a schematic diagram of an image processing device 100 and a display panel 200 in some embodiments of the present disclosure. The image processing device 100 is configured to receive an original display signal Sd1, and is configured to convert the original display signal Sd1 to an output display signal Sd2. The output display signal Sd2 is provided to the display panel 200, so that multiple pixels of the display panel 200 may be driven to display an image frame.

Referring to FIG. 1, in one embodiment, the display panel 200 may be an OLED panel with delta pixel arrangement and include a plurality of pixel region R, and may display the image frame according to the output display signal Sd2. A full-color pixel is formed in each of the pixel regions R and includes three subpixels denoted as R, G, B, respectively displaying red, green and blue colors.

The image processing device 100 at least includes an input data conversion circuit 110 and a subpixel rendering circuit 140. The input data conversion circuit 110 is configured to receive the original display signal Sd1 (e.g., grayscale values). The original display signal Sd1 corresponds to one image frame and includes a plurality of grayscale values of subpixels of the image frame, and the input data conversion circuit 110 may convert the original display signal Sd1 to obtain multiple luminance values SL of subpixels of the image frame.

Figure 2:
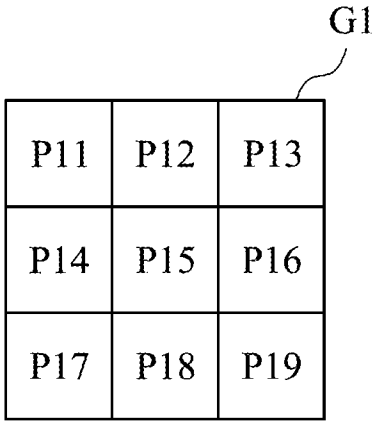
FIG. 2 is a schematic diagram of the first subpixel group in some embodiments of the present disclosure.

The subpixel rendering circuit 140 is electrically coupled to the input data conversion circuit 110, and is configured to perform a subpixel rendering conversion on a luminance value of a target subpixel P(j,i), called target luminance value hereinafter, to generate a render luminance value. P(j,i) denotes one subpixel of a pixel positioned at j-th pixel row and i-th pixel column. To generate the render luminance value, not only the target luminance but also luminance values of a plurality of same-colored subpixels adjacent to the target subpixel are also considered. The target subpixel and those adjacent subpixels associated with the SPR conversion form a first subpixel group, such as a first subpixel group G1. FIG. 2 is a schematic diagram of the first subpixel group G1 in some embodiments of the present disclosure. In one embodiment, the first subpixel group G1 includes multiple same colored subpixels P11-P19 as a 3*3 subpixel matrix, which can be red subpixels, green subpixels or blue subpixels. The target subpixel P(j,i) is regarded as the center subpixel, denoted as P15, and the adjacent subpixels are denoted as P11-P14 and P16-P19, which are subpixels positioned at pixel rows and pixel columns adjacent to the target subpixel P15. In another embodiment, the first subpixel group may consist of the target subpixel and adjacent subpixels only at the pixel row same as where the target subpixel is.

The above luminance values SL converted from the original display signal Sd1 includes multiple first luminance values, and the first luminance values corresponds to subpixels P11-P19 of the first subpixel group G1. The first luminance values include the target luminance value and multiple adjacent luminance values. The target luminance value and the multiple adjacent luminance values correspond to the target subpixel P15 and the adjacent subpixels P11-P14 and P16-P19, respectively, but the present disclosure is not limited to this.

The subpixel rendering circuit 140 is configured to perform the subpixel rendering conversion on the target luminance value according to a weighting matrix and all of the first luminance values of the first subpixel group. The target luminance value is converted to the rendered luminance value by the subpixel rendering conversion. The weighting matrix is time-variant, and comprises multiple weighting parameters corresponding to the first subpixel group G1. That is, not all of the weighting parameters are constant values. For example, at least one weighting parameter of the weighting matrix may be set to a value determined by a time-dependent function, and each of remaining weighting parameters may be constant values. For another example, some weighting parameters of the weighting matrix may be determined by respective time-dependent functions, and some other weighting parameters may be constant values. Details of subpixel rendering conversion, the time-dependent function and the weighting matrix will be explained in subsequent paragraphs.

By generating the rendered luminance value according to the time-variant weighting matrix, the visual color shift on a displayed object edge having significant luminance difference from pixels adjacent to the displayed object edge may be eased. The effect of reducing visual color shift is more significant when the displayed object edge keeps still.

The following matrix represents the first luminance values of the first subpixel group G1 consisting of the subpixels P11-P19. Referring to the following matrix and the FIG. 2, the first luminance values of the first subpixel group G1 include a target luminance value L15 and multiple adjacent luminance values L11-L14 and L16-L19. The target luminance value L15 corresponds to the target subpixel P15, and the adjacent luminance values L11-L14 and L16-L19 correspond to the adjacent subpixels P11-P14 and P16-P19, respectively.

$$\begin{bmatrix} L11 & L12 & L13 \\ L14 & L15 & L16 \\ L17 & L18 & L19 \end{bmatrix}$$

The following matrix is the weight matrix including a target weighting parameter W15 and multiple adjacent weighting parameters W11-W14 and W16-W19. The target weighting parameter W15 corresponds to the target subpixel P15, and the adjacent weighting parameters W11-W14 and W16-W19 corresponds to the adjacent subpixels P11-P14 and P16-P19, respectively. The summation of all the elements of the weight matrix, such as the target weighting parameter W15 and adjacent weighting parameters W11-W14 and W16-W19, equals one.

$$\begin{bmatrix} W11 & W12 & W13 \\ W14 & W15 & W16 \\ W17 & W18 & W19 \end{bmatrix}$$

In some embodiments, when the subpixel rendering circuit 140 performs the subpixel rendering conversion, the subpixel rendering circuit 140 multiplies each of the first luminance values of the first subpixel group with respect to each target subpixel by the corresponding weighting parameter. The subpixel rendering circuit 140 then sums the result of the multiplication to obtain the rendered luminance value of the target subpixel. In other words, the calculation formula of the rendered luminance value corresponding to the target subpixel P15 is (L11×W11)+(L12×W12)+(L13×W13)+(L14×W14)+(L15×W15)+(L16×W16)+(L17×W17)+(L18×W18)+(L19×W19).

Figure 3A:
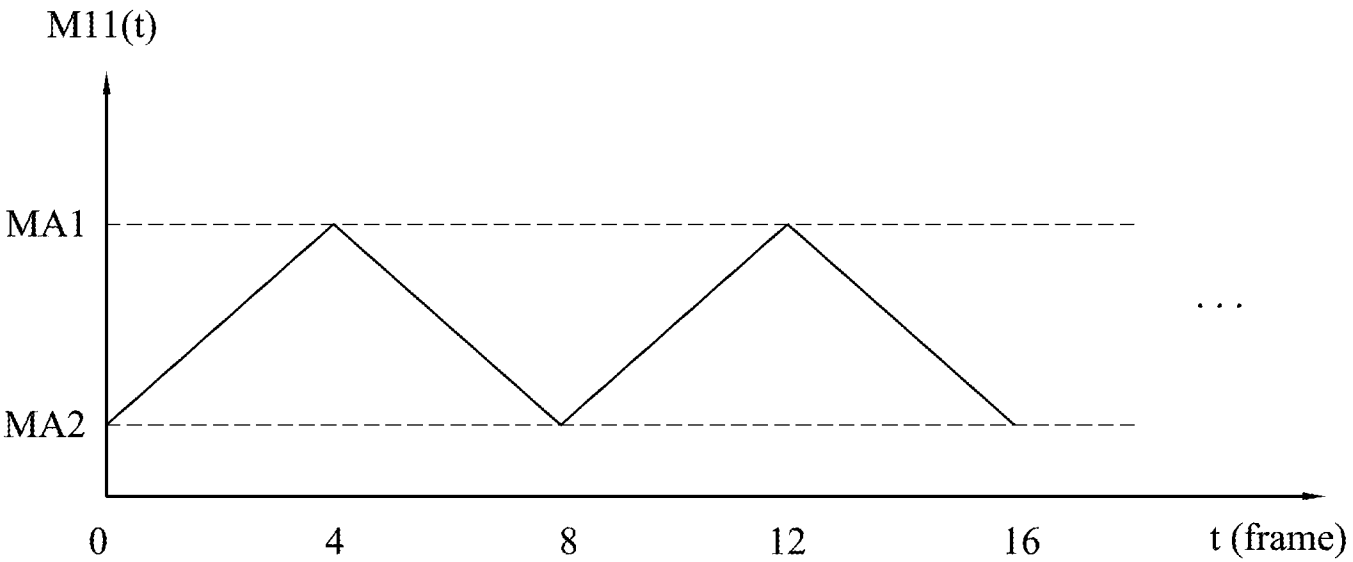
FIGS. 3A and 3B are waveforms of the time-dependent functions in some embodiments of the present disclosure.
Figure 3B:
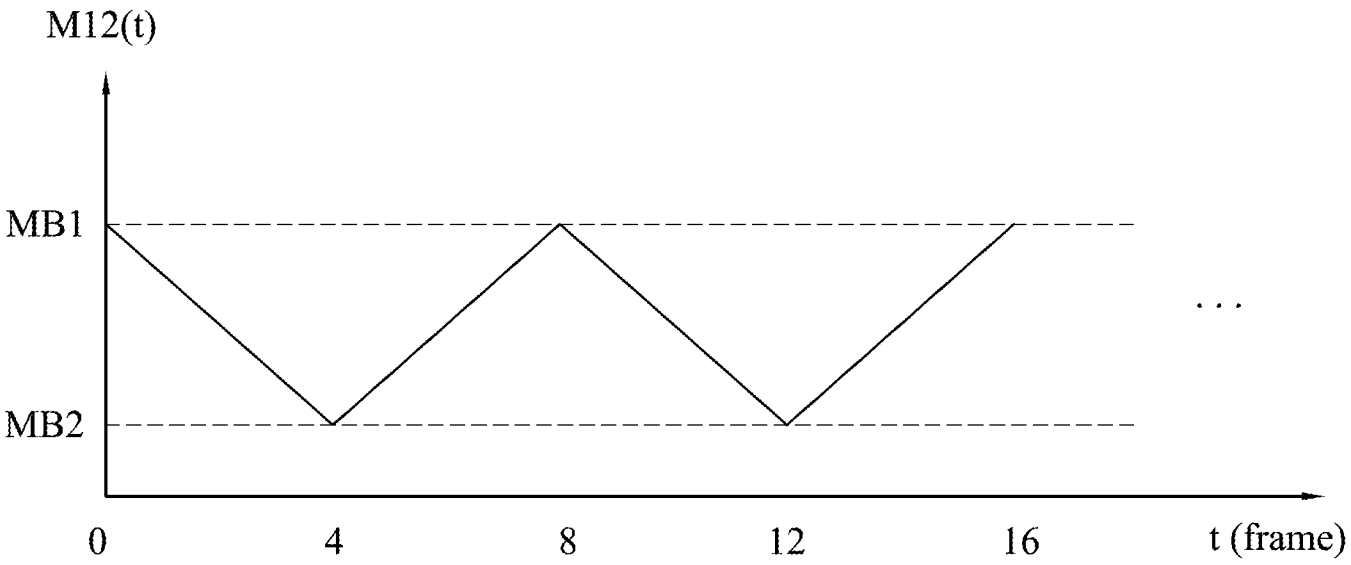

As mentioned above, the weighting matrix is time-variant. In other words, at least one of the weighting parameter is time-variant, and may have a value determined by a time-dependent function. In some embodiments, the value determined by the time-dependent function is between an upper limit value and a lower limit value. FIG. 3A and FIG. 3B show waveforms of the time-dependent functions M11(t) and M12(t) each can be used to determine the weighting parameter, according to some embodiments of the present disclosure. The vertical axis represents the value of the time-dependent function. The horizontal axis represents time, such as frame time which means the corresponding frame order at different times. The value of the time-dependent function M11(t) changes gradually between the upper limit value MA1 and the lower limit value MA2 according to time. The value of the time-dependent function M12(t) changes gradually between the upper limit value MB1 and the lower limit value MB2 according to time.

Figure 4A:
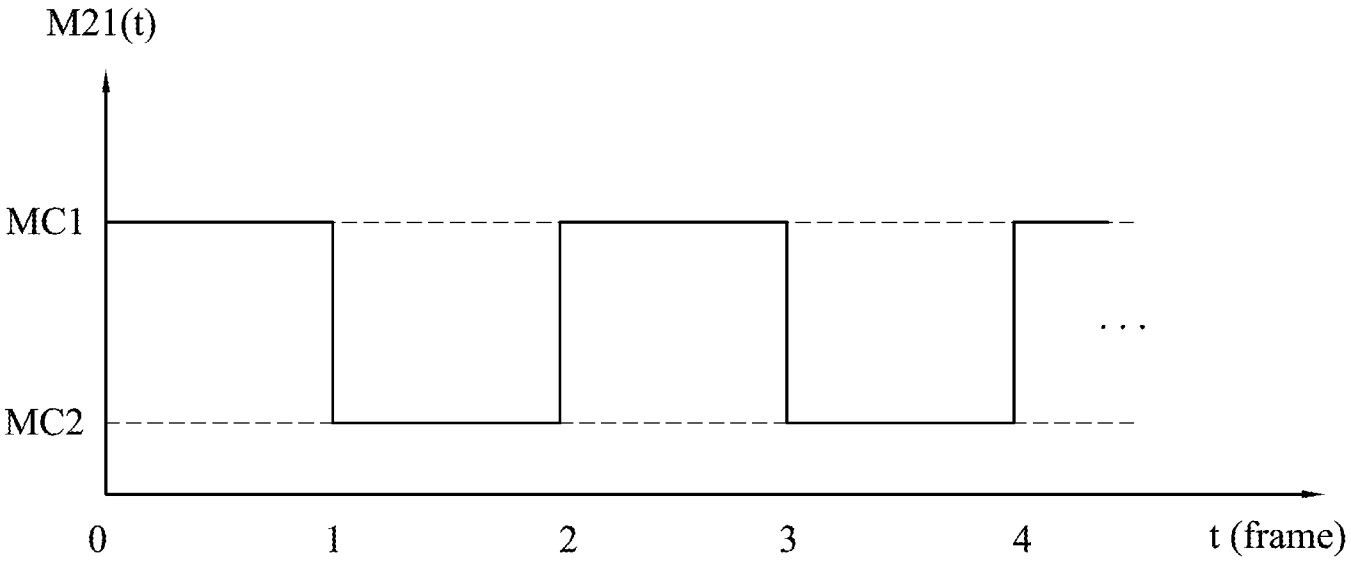
FIGS. 4A and 4B are waveforms of the time-dependent functions in some embodiments of the present disclosure.
Figure 4B:
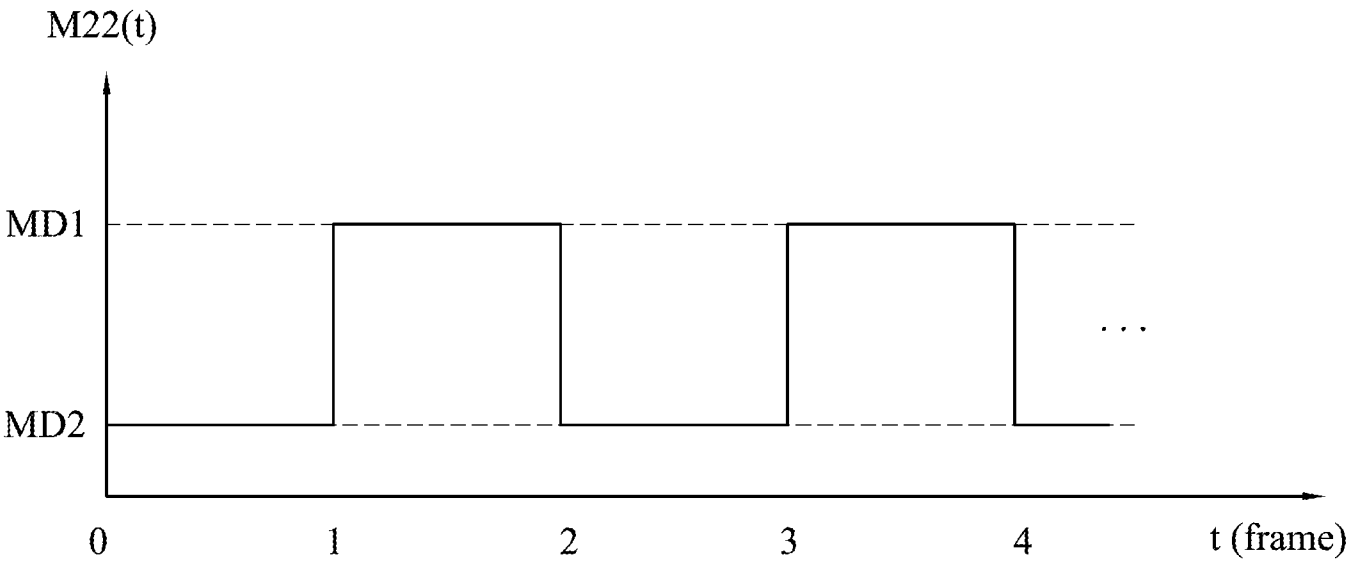

FIG. 4A and FIG. 4B show waveforms of the time-dependent functions M21(t) and M22(t) each can be used to determine the weighting parameter, according to some embodiments of the present disclosure. In some embodiments of the present disclosure, the value of the time-dependent function M21(t) is switched between the upper limit value MC1 and the lower limit value MC2 according to time, such as frame time which means the corresponding frame order at different times. The value of the time-dependent function M22(t) is switched between the upper limit value MD1 and the lower limit value MD2 according to time. One or more proper time-dependent functions to determine the weighting parameters of the weight matrix for the target subpixel may be selected according to luminance edge characteristic the target subpixel, which represents a situation of the luminance difference displayed by the target subpixel and adjacent subpixels of the same color.

Figure 5:
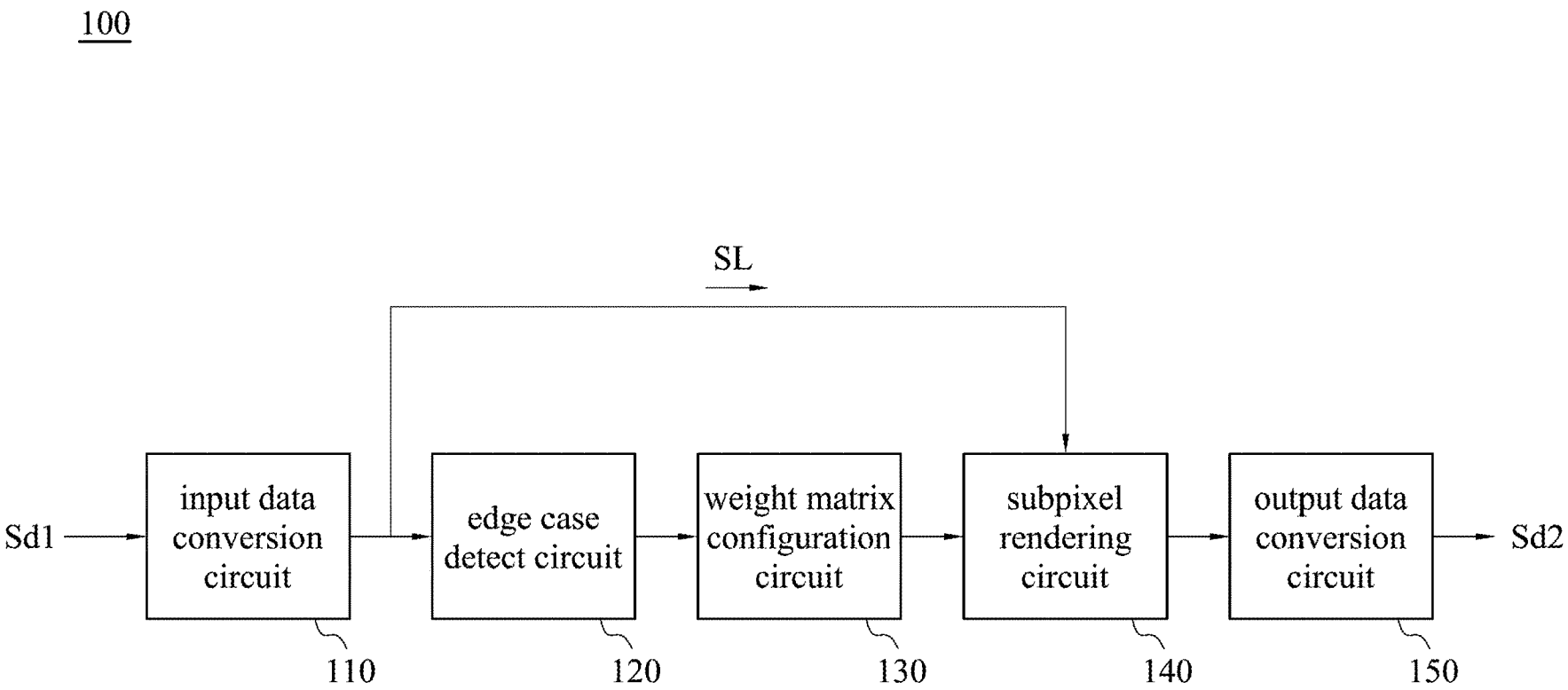
FIG. 5 is a schematic diagram of the image processing device in some embodiments of the present disclosure.

FIG. 5 is a schematic diagram of the image processing device 100 in some embodiments of the present disclosure. In some embodiments, the image processing device 100 further includes an edge case detect circuit 120, a weight matrix configuration circuit 130 and an output data conversion circuit 150. The edge case detect circuit 120 is electrically coupled to the input data conversion circuit 110, and configured to determine a difference between the target luminance value and each of a part of adjacent luminance values and to identify the kind of a luminance edge characteristic the target subpixel has according to the differences. The above "a part of adjacent luminance values" may be luminance values corresponding to adjacent subpixels P11-P14 and P16-P19, or at least two adjacent luminance values corresponding to two adjacent subpixels in a direction, such as adjacent subpixels P14 and P16 in a horizontal direction, or subpixels P12 and P18 in a vertical direction. The edge case detect circuit 120 is configured to identify the luminance edge characteristic the target subpixel has.

The weight matrix configuration circuit 130 is electrically coupled to the edge case detect circuit 120, and is configured to set the weighting parameters. In some embodiments, the weight matrix configuration circuit 130 is configured to set the target weighting parameter W15 to a value determined by a time-dependent function according to the luminance edge characteristic of the target subpixel P15.

For example, in a condition that the edge case detect circuit 120 determines that a difference (i.e. luminance difference) between the target luminance value and an adjacent luminance value corresponding to the adjacent subpixel P14 does not exceed a threshold and also determines that an adjacent luminance value corresponding to the adjacent subpixel P16 is smaller than the target luminance value and a difference between them exceeds the threshold, the luminance edge characteristic of the target subpixel may be identified as a first edge case. In another condition that the edge case detect circuit 120 determines that the adjacent luminance value corresponding to the adjacent subpixel P14 is larger than the target luminance value and a difference between them exceeds the threshold and also determines that the target luminance value and the adjacent luminance value corresponding to the adjacent subpixel P16 does not exceed the threshold, the luminance edge characteristic of the target subpixel may be identified as a second edge case. Base on a determined edge case, a corresponding time-dependent function or a constant value is determined accordingly.

The weight matrix configuration circuit 130 may set the target weighting parameter W15 according to a first time-dependent function in a condition that the luminance edge characteristic of the target subpixel P15 is identified as the first edge case, and may set the target weighting parameter W15 according to a second time-dependent function in a condition that the luminance edge characteristic of the target subpixel P15 is identified as the second edge case. Similarly, the weight matrix configuration circuit 130 may set the target weighting parameter W15 as a first constant value in a condition that the luminance edge characteristic of the target subpixel P15 is identified as a third edge case, or may set the target weighting parameter W15 as a second constant value in a condition that the luminance edge characteristic of the target subpixel P15 is identified as a fourth edge case.

In addition, based on an identified luminance edge characteristic (i.e. edge case) of the target subpixel, the weight matrix configuration circuit 130 may further choose, for each adjacent subpixel of the first subpixel group (that is associated with SPR conversion), a proper time-dependent functions or constant values to set each of adjacent weighting parameters.

The output data conversion circuit 150 is electrically coupled to the subpixel rendering circuit 140. The output data conversion circuit 150 is configured to receive the rendered luminance value, and is configured to convert the rendered luminance value to the output display signal Sd2 (e.g., the output grayscale value). The output data conversion circuit 150 transmits the output display signal Sd2 to the display panel 200.

In some embodiments, in response to that the original display signal Sd1 changes or not, the weight matrix configuration circuit 130 may update the weighting parameter by using a different time-dependent function (or a different constant value) or by using the same time-dependent function (or same constant value). For example, for N-th frame, the target weighting parameter W15 of the target subpixel is determined by the time-dependent function M11(t) shown in FIG. 3A according to a first luminance edge characteristic. At this time, the target weighting parameter W15 is set to the lower limit value MA2 at t=0 (frame time). For (N+1)-th frame, the target weighting parameter W15 of the target subpixel is still determined by the time-dependent function M11(t) since the luminance edge characteristic of the target subpixel (at the same position) does not change. At this time, the target weighting parameter W15 is set to (¾)*MA2+(¼)*MA1 at t=1 (frame time). For (N+2)-th frame, the target weighting parameter W15 of the target subpixel is still determined by the time-dependent function M11(t) since the luminance edge characteristic of the target subpixel (at the same position) does not change. At this time, the target weighting parameter W15 is set to (2/4)*MA2+(2/4)*MA1 at t=2 (frame time). For (N+3)-th frame, the target weighting parameter W15 of the target subpixel is still determined by the time-dependent function M11(t) since the luminance edge characteristic of the target subpixel (at the same position) does not change. At this time, the target weighting parameter W15 is set to (¼)*MA2+(¾)*MA1 at t=3 (frame time). For (N+4)-th frame, when t=4, the target subpixel P15 changes from having the first luminance edge characteristic to having a second luminance edge characteristic, so that the target weighting parameter W15 is not set to MA1 at t=4 (frame time) of the time-dependent function M11(t) but determined according to another time-dependent function M21(t) shown in FIG. 4A. At this time, the target weighting parameter W15 is set to MC1 at t=0 (frame time) of the time-dependent function M21(t) shown in FIG. 4A.

In one embodiment, the summation of the target weighting parameter W15 and adjacent weighting parameters W11-W14 and W16-W19 equals one. Accordingly, once one of the weighting parameters changes, at least another weighting parameter will change accordingly. In a condition that the target weighting parameter W15 is determined by a first time-dependent function, at least one of the adjacent weighting parameters W11-W14 and W16-W19 is determined by a second time-dependent function different from the first time-dependent function.

For example, the target weighting parameter W15 is determined by the time-dependent function M11(t) shown in FIG. 3A selected according to the identified luminance edge characteristic. The value of the time-dependent function M11(t) varies between the upper limit value MA1 (e.g., ¾) and the lower limit value MA2 (e.g., ¼). Based on the luminance edge characteristic of the target subpixel, the four adjacent weighting parameters W12, W14, W16 and W18 of the adjacent subpixels P12, P14, P16, P18 may be determined by a time-dependent function M12(t) shown in FIG. 3B different from the time-dependent function M11(t), and the other four adjacent weighting parameters W11, W13, W17, W19 of the adjacent subpixels P11, P13, P17, P19 may be set to a constant value, zero. The value of time-dependent function M12(t) varies between the upper limit value MB1 (e.g., ⅛) and the lower limit value MB2 (e.g., 1/16). The example of how the weighting matrix varies with time is given as follows, based on a condition that the identified luminance edge characteristic of the target subpixel does not change. The weighting parameters of the weighting matrix have initial values at the first frame, t=0 (frame time). The weighting parameters of the weighting matrix have different values corresponding to the second frame, the third frame, the fourth frame and the fifth frame at t=1, 2, 3 and 4 (frame time), respectively, and so on.

$$\text{At } t=0, \text{ the weighting matrix} = \begin{bmatrix} 0 & 1/8 & 0 \\ 1/8 & 1/2 & 1/8 \\ 0 & 1/8 & 0 \end{bmatrix}$$

$$\text{At } t=1, \text{ the weighting matrix} = \begin{bmatrix} 0 & 7/64 & 0 \\ 7/64 & 9/16 & 7/64 \\ 0 & 7/64 & 0 \end{bmatrix}$$

$$\text{At } t=2, \text{ the weighting matrix} = \begin{bmatrix} 0 & 3/32 & 0 \\ 3/32 & 5/8 & 3/32 \\ 0 & 3/32 & 0 \end{bmatrix}$$

$$\text{At } t=3, \text{ the weighting matrix} = \begin{bmatrix} 0 & 5/64 & 0 \\ 5/64 & 11/16 & 5/64 \\ 0 & 5/64 & 0 \end{bmatrix}$$

$$\text{At } t=4, \text{ the weighting matrix} = \begin{bmatrix} 0 & 1/16 & 0 \\ 1/16 & 3/4 & 1/16 \\ 0 & 1/16 & 0 \end{bmatrix}$$

Reference is made to FIG. 4A and FIG. 4B. Another example of how the weighting matrix varies with time is given as follows, in which the target weighting parameter W15 is set to a constant value, 1/2, according to the identified luminance edge characteristic. Based on the luminance edge characteristic of the target subpixel, the adjacent weighting parameter W14 of the adjacent subpixel P14 may be determined by the time-dependent function M21(t) shown in FIG. 4A and the adjacent weighting parameter W16 of the adjacent subpixel P16 may be determined by the time-dependent function M22(t) shown in FIG. 4B. The other six adjacent weighting parameters W11-W13 and W17-W19 of the adjacent subpixels P11-P13 and P17-P19 may be set to a constant value, zero. Here is the another example of how the weighting matrix varies with time, based on a condition that the identified luminance edge characteristic of the target subpixel does not change.

$$\text{At } t=0, \text{ the weighting matrix} = \begin{bmatrix} 0 & 0 & 0 \\ 1/2 & 1/2 & 0 \\ 0 & 0 & 0 \end{bmatrix}$$

$$\text{At } t=1, \text{ the weighting matrix} = \begin{bmatrix} 0 & 0 & 0 \\ 0 & 1/2 & 1/2 \\ 0 & 0 & 0 \end{bmatrix}$$

$$\text{At } t=2, \text{ the weighting matrix} = \begin{bmatrix} 0 & 0 & 0 \\ 1/2 & 1/2 & 0 \\ 0 & 0 & 0 \end{bmatrix}$$

$$\text{At } t=3, \text{ the weighting matrix} = \begin{bmatrix} 0 & 0 & 0 \\ 0 & 1/2 & 1/2 \\ 0 & 0 & 0 \end{bmatrix}$$

$$\text{At } t=4, \text{ the weighting matrix} = \begin{bmatrix} 0 & 0 & 0 \\ 1/2 & 1/2 & 0 \\ 0 & 0 & 0 \end{bmatrix}$$

Figure 6:
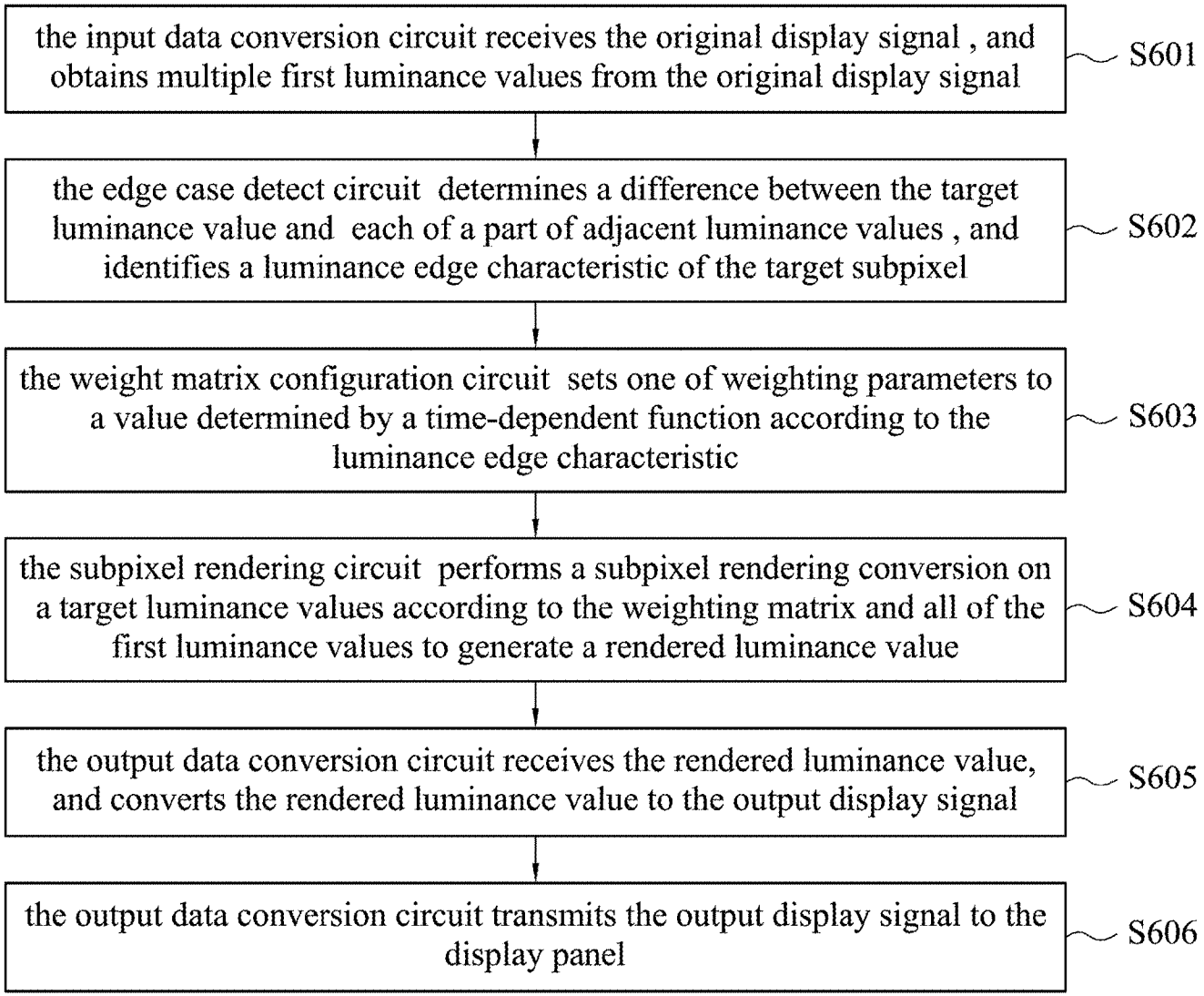
FIG. 6 is a flowchart illustrating an image processing method in some embodiments of the present disclosure.

FIG. 6 is a flowchart illustrating an image processing method in some embodiments of the present disclosure. The image processing method includes steps S601-S606. In step S601, the input data conversion circuit 110 receives the original display signal Sd1 corresponding to an input frame, and obtains multiple first luminance values from the original display signal Sd1. The first luminance values correspond to a first subpixel group G1 (e.g., the target subpixel P15 and multiple adjacent subpixels which are associated with the SPR conversion on the target subpixel P15, such as adjacent subpixels P11-P14 and P16-P19).

In step S602, the edge case detect circuit 120 determines a difference between the target luminance value and each of a part of adjacent luminance values and identifies what kind of the luminance edge characteristic the target subpixel P15 has according to the differences. In step S603, the weight matrix configuration circuit 130 sets at least one of weighting parameters (e.g., target weighting parameter) to a value determined by a time-dependent function or a constant value selected according to the luminance edge characteristic of the target subpixel P15. In some embodiments, when the target weighting parameter is determined by the first time-dependent function, one of the adjacent weighting parameters will be determined by a second time-dependent function different from the first time-dependent function, and the summation of the target weighting parameter and the adjacent weighting parameters equals one.

In step S604, after determining the weighting parameters of the weight matrix, the subpixel rendering circuit 140 performs a subpixel rendering conversion on a target luminance value of the target subpixel according to the weighting matrix and all of the first luminance values, so that the target luminance value is converted to a rendered luminance value.

In step S605, the output data conversion circuit 150 receives the rendered luminance value, and converts the rendered luminance value to the output display signal Sd2. In step S606, the output data conversion circuit 150 transmits the output display signal Sd2 to the display panel 200, so that multiple pixels of the display panel 200 may be driven to display an output frame.

The image processing device 100 may repeat the above steps S601-S606 for the different original display signal corresponding to the different image frames, so as to generate multiple output frames by performing the subpixel rendering conversion on multiple consecutive input frames. Benefit from generating the rendered luminance value according to the time-variant weighting matrix, the visual color shift on a displayed object edge having significant luminance difference from pixels adjacent to the displayed object edge may be eased.

It will be apparent to those skilled in the art that various modifications and variations can be made to the structure of the present disclosure without departing from the scope or spirit of the present disclosure. In view of the foregoing, it is intended that the present disclosure cover modifications and variations of this present disclosure provided they fall within the scope of the following claims.

What is claimed is:

1. An image processing method, comprising:

obtaining a plurality of first luminance values, wherein the plurality of first luminance values corresponds to a first subpixel group comprising a target subpixel and a plurality of adjacent subpixels; and performing a subpixel rendering conversion on a target luminance value of the plurality of first luminance values corresponding to the target subpixel according to a weighting matrix and all of the plurality of first luminance values, so that the target luminance value is converted to a rendered luminance value, wherein the weighting matrix comprises a plurality of weighting parameters corresponding to the first subpixel group, and the weighting matrix is time-variant.

2. The image processing method of claim 1, wherein one of the weighting parameters of the weighting matrix is set to a value determined by a time-dependent function.

3. The image processing method of claim 1, wherein the plurality of first luminance values comprises the target luminance value and a plurality of adjacent luminance values, the plurality of adjacent luminance values correspond to the plurality of adjacent subpixels, the plurality of weighting parameters comprises a target weighting parameter and a plurality of adjacent weighting parameters, and the image processing method further comprises:

before performing the subpixel rendering conversion, determining a difference between the target luminance value and each of a part of the plurality of adjacent luminance values and identifying a luminance edge characteristic of the target subpixel according to the differences; and setting the target weighting parameter of the weighting matrix to a value determined by a first time-dependent function selected according to the luminance edge characteristic of the target subpixel.

4. The image processing method of claim 3, wherein in a condition that the target weighting parameter of the weighting matrix is determined by the first time-dependent function, one of the plurality of adjacent weighting parameters is determined by a second time-dependent function different from the first time-dependent function.

5. The image processing method of claim 3, wherein the part of the plurality of adjacent luminance values are at least two adjacent luminance values of adjacent subpixels which are adjacent to the target subpixel in a horizontal direction.

6. The image processing method of claim 5, wherein the plurality of adjacent subpixels have a same color as the target subpixel.

7. The image processing method of claim 3, wherein a summation of the target weighting parameter and the plurality of adjacent weighting parameters of the weighting matrix equals one.

8. The image processing method of claim 3, wherein the value determined by the first time-dependent function is between an upper limit value and a lower limit value.

9. An image processing device, comprising:

a input data conversion circuit configured to obtain a plurality of first luminance values, wherein the plurality of first luminance values corresponds to a first subpixel group comprising a target subpixel and a plurality of adjacent subpixels; and a subpixel rendering circuit electrically coupled to the input data conversion circuit, and configured to perform a subpixel rendering conversion on a target luminance value of the plurality of first luminance values corresponds to the target subpixel according to a weighting matrix and all of the plurality of first luminance values, wherein the target luminance value is converted to a rendered luminance value, the weighting matrix is time-variant, and comprises a plurality of weighting parameters corresponding to the first subpixel group.

10. The image processing device of claim 9, wherein one of the plurality of weighting parameters is set to a value determined by a time-dependent function.

11. The image processing device of claim 9, wherein the plurality of first luminance values comprises the target luminance value and a plurality of adjacent luminance values, the plurality of adjacent luminance values correspond to the plurality of adjacent subpixels, the plurality of weighting parameters comprises a target weighting parameter and a plurality of adjacent weighting parameters, and the image processing device further comprises:

an edge case detect circuit electrically coupled to the input data conversion circuit, and configured to determine a difference between the target luminance value and each of a part of the plurality of adjacent luminance values and to identify a luminance edge characteristic of the target subpixel according to the differences; and a weight matrix configuration circuit electrically coupled to the edge case detect circuit, and configured to set the target weighting parameter to a value determined by a first time-dependent function selected according to the luminance edge characteristic of the target subpixel.

12. The image processing device of claim 11, wherein in a condition that the target weighting parameter of the weighting matrix is set to the value determined by the first time-dependent function, one of the plurality of adjacent weighting parameters is set to a second time-dependent function different from the first time-dependent function.

13. The image processing device of claim 11, wherein the part of the plurality of adjacent luminance values are at least two adjacent luminance values of adjacent subpixels which are adjacent to the target subpixel in a horizontal direction.

14. The image processing device of claim 13, wherein the plurality of adjacent subpixels have a same color as the target subpixel.

15. The image processing device of claim 11, wherein a summation of the target weighting parameter and the plurality of adjacent weighting parameters of the weighting matrix equals one.

16. The image processing device of claim 11, wherein the value determined by the first time-dependent function is between an upper limit value and a lower limit value.

* * * * *